US006182873B1

(12) United States Patent
Christopher et al.

(10) Patent No.: US 6,182,873 B1
(45) Date of Patent: Feb. 6, 2001

(54) INFANT CARRIER

(76) Inventors: Peter A. Christopher; Ann L. Lorenzini, both of P.O. Box 43, Johnson, VT (US) 05656

( * ) Notice: Under 35 U.S.C. 154(b), the term of this patent shall be extended for 0 days.

(21) Appl. No.: 08/903,053

(22) Filed: Jul. 30, 1997

(51) Int. Cl.[7] ..... A61G 1/00

(52) U.S. Cl. ..... 224/159; 229/160

(58) Field of Search ..... 224/159, 158, 224/160

(56) References Cited

U.S. PATENT DOCUMENTS 2,056,925 * 10/1936 Kimbrough ..... 224/264
4,389,005 * 6/1983 Cable et al. ..... 224/159
4,492,326 * 1/1985 Storm ..... 224/159

* cited by examiner

*Primary Examiner*—Gregory M. Vidovich
*Assistant Examiner*—Maerena Brevard

(57) ABSTRACT

An infant side carrier with a flexible seat (12) that is surrounded by a soft adjustable frame (74,76) made from conventional safety strap material. The seat's high back, wrap around sides and extended leg openings fully support the infant's torso, hips and thighs. The adjustable frame allows the adult to adjust the shoulder strap separately from the seat. The seat can be adjusted to tailor fit each individual infant. The infant's weight is distributed across a large surface area on the adult's body. The carrier attaches to the adult's body with a wide waist belt (13) and a shoulder strap with a padded shoulder wrap (60). The wide waist belt is joined to the seat at the underside of the belt, creating a seat that does not come between the adult and the infant. The padded shoulder wrap (60) has an elliptical peripheral configuration that utilizes the clavicle bone, shoulder joint and upper portion of the humerus bone. The padded shoulder wrap reduces shoulder discomfort while allowing the arm to move freely. The shoulder strap can also be modified for use for apparatus (10) or to transport moderately heavy loads such as luggage, athletic equipment, computer equipment, etc.

15 Claims, 7 Drawing Sheets

INFANT CARRIER

BACKGROUND

1. Field of Invention

This invention relates to a soft-type, side positioning infant carrier.

2. Discussion of Prior Art

Various kinds of carriers have been devised for enabling an adult to carry an infant on the hip. Such prior art has been limited by problems of comfort and adjustability for the infant and adult.

The first problem of comfort has been partially solved by utilizing two regions of the adult's body for weight distribution. The weight of the infant has typically been distributed to the shoulder and/or the waist regions. For example, the following patents only utilize one strap to either the shoulder or the waist. (See U.S. Pat. Nos. 4,389,005; 4,790,459; 4,901,898.) All of the infant carriers disclosed in these patents do not have the advantages of using an additional weight distribution strap.

Infant carriers that utilize both a shoulder strap and a waist strap can be seen in U.S. Pat. Nos. 4,436,233; 4,487,346; 4,724,987; 4,915,277; 4,986,458; 5,441,186. These infant carriers attempt to take advantage of the hip position and the combined attributes of a shoulder strap(s) and a waist strap. However, these carriers have narrow shoulder straps which cause neck and shoulder pain.

The adult carries a large portion of the infant's weight on the shoulder strap. Generally, prior art has focused on placing the shoulder strap over the clavicle bone. The bone has little muscular padding and becomes sore quickly. U.S. Pat. Nos. 4,389,005 and 4,724,987 have begun to address this issue, but were unable to fully solve other infant carrier issues and U.S. Pat. No. 4,389,005 did not have a waist strap.

Child comfort has also been addressed in prior art, but there are still significant problems with providing a seat which fully supports the child. When the child is sitting upright there needs to be a large surface area to support the child's hips and thighs. This ensures that the child remains comfortable and his/her back and hips are not unnecessarily stressed (for example, the seat portion of U.S. Pat. Nos. 4,436,233, 4,915,277 and 4,901,898 only support the infants hips.)

An additional area not addressed in prior art is full torso support for the child. The child carrier must fully wrap around the child's sides and extend up the child's back to ensure against the possibility of falling backwards or out the sides. The seat portion of the aboverientioned U.S. Pat. Nos. only have lower back support and the sides do not fully wrap around the child. U.S. Pat. Nos. 4,487,346, 4,389,005 and 4,915,277 have added separate back or side straps for support. However, these can slip and leave large portions of the child's body unsupported.

SUMMARY OF THE INVENTION

An infant carrier with a fabric seat surrounded by an adjustable soft frame made of strap material. The seat is supported by a waist belt and a shoulder strap. The shoulder strap contains a padded shoulder wrap that covers the shoulder area, distributing the infant's weight evenly across the adult's shoulder region. The carrier seat is surrounded by two straps to support and accommodate changes in infant size. The seat's straps also allow the infant's seat to be adjusted separately from the adult's shoulder strap. This is accomplished by using separate straps to adjust the infant's seat and the adult's shoulder strap. The straps surrounding the seat are also wide enough not to constrict blood flow or decrease infant comfort.

The main object of the invention is to create an infant carrier with improved comfort for the infant. This is accomplished by creating a seat with: a high back, wrap around sides, an extended seat for thigh support and an adjustable soft frame made of strap. The seat utilizes a large surface area to support an infant and can be individually adjusted to tailor fit each infant.

Another object of the invention is to create an infant carrier that is of improved comfort to the adult wearer. This is accomplished by the dual factors: a wide waist belt coupled with the shoulder strap means. The portion of the carrier weight borne by the wearer's waist is spread over a broad area Lo dissipate the forces, and the portion of the carrier weight borne by the wearer's shoulder is distributed over the upper humerus bone, shoulder joint and the clavicle bone. The adult is also able to adjust the shoulder strap separately to individualize adjustments for both their infant and themselves. The middle region of the shoulder strap termed—shoulder wrap—is padded with a foam like material. The shoulder wrap gives the adult wearer comfort, while allowing the arm to move freely.

A preferred embodiment of the invention will now be described by way of example and with reference to the accompanying drawings.

DRAWING REFERENCE NUMERALS WORKSHEET

Figure 1A:
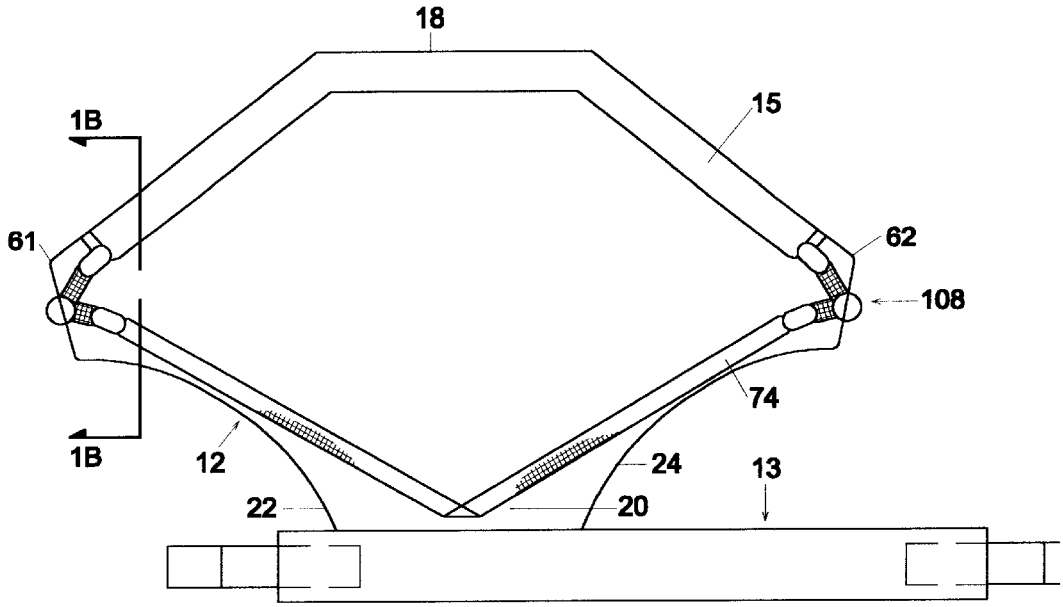
FIG. 1A is a plan view of the outside of the seat and waist belt.

10 apparatus
12 seat assembly
13 waist belt assembly
14 waist belt
15 seat body
18 seat upper edge
20 seat lower edge
22,24 seat lower side edges
26 suspension rings
34,35 complimentary buckles
37 snap fasteners
38 bar slide

40 seat adjustable fasteners
41 shoulder strap adjustable fastener
44 waist strap left
45 waist strap right
46 shoulder strap back
47 waist strap guides
48 shoulder strap,long front
50 shoulder strap, short front
60 shoulder wrap assembly
61,62 seat middle edges
71 seat Lower strap stitches
72 seat upper strap casing
73 support strap stitches
74 seat lower strap
75 seat top stitching
76 seat upper strap
77 buttonhole stitches
78 support straps
79 lower casing stitches
80 shoulder wrap top
82 shoulder wrap side
84 shoulder wrap foam insert
86 shoulder wrap attachments
87 shoulder wrap box stitches
90 buttonholes
102 seat lower portion
104 seat upper back portion
105 strap material
108 seat middle side portion
109 waist belt lower edge

DETAILED DESCRIPTION

Figure 1B:
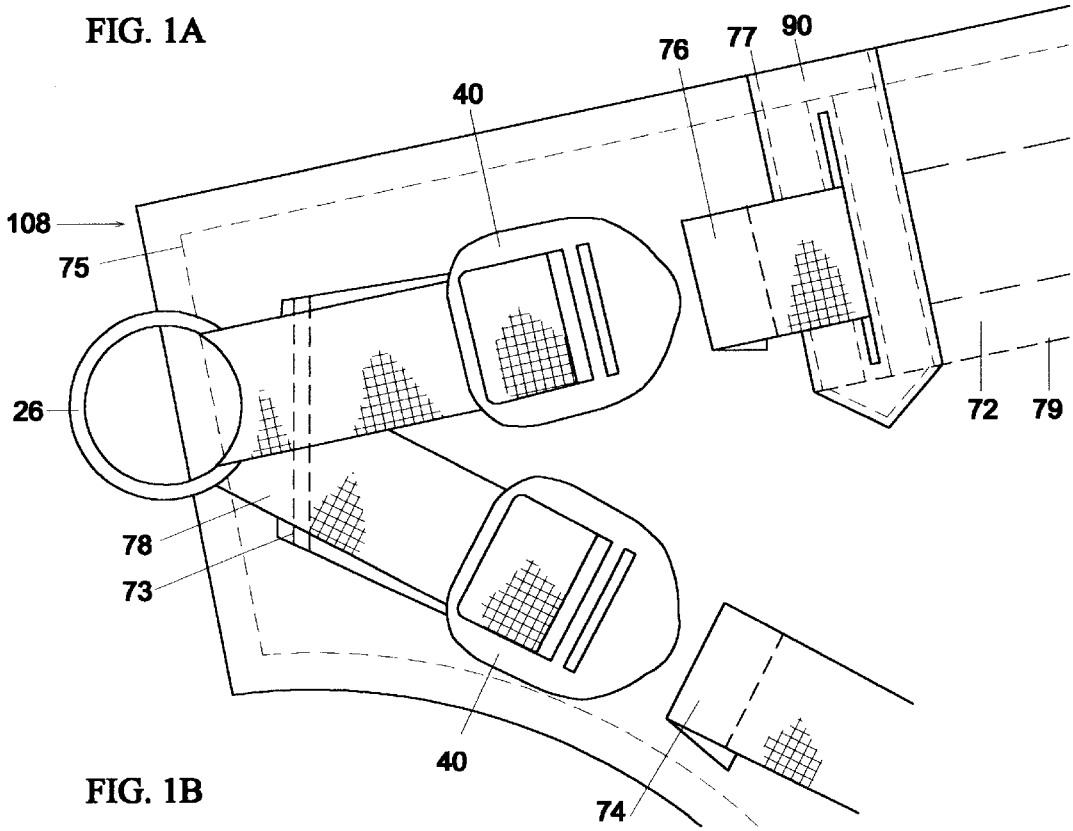
FIG. 1B is a detailed fragmentary sectional view taken on line 1B—1B of FIG. 1A.
Figure 2:
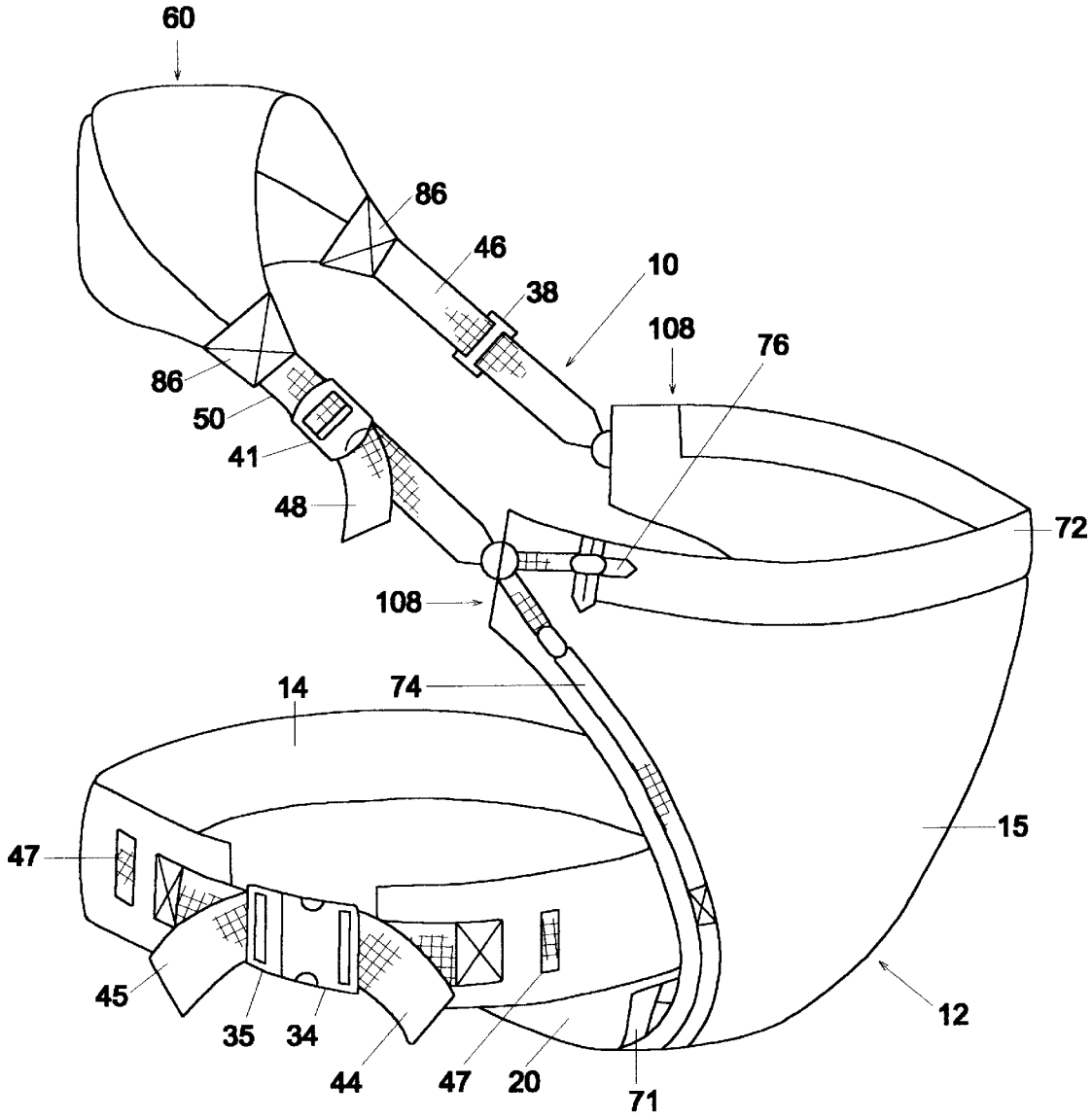
FIG. 2 is a schematic view of the apparatus as used.

The seat assembly 12 is surrounded by an adjustable soft frame made from a pair of straps 74 and 76, as shown in FIGS. 1A and 2. This framework supplies the necessary adjustability and safety for the infant. The seat lower strap 74 is attached to the bottom of seat by rows of stitching 71 and seat upper strap is encased by a fabric material 72, two rows of stitching 75,79 and emerges through two buttonholed pieces of fabric material 90. The two buttonholed pieces 90 are sewn in place with rows of stitches 77. FIGS. 1A and 2 best show the configuration of straps 74 and 76 relative to their positions on seat. The straps are fastened and adjusted using adjustable fasteners 40 which are attached to a support strap 78 that is passed through a suspension ring 26, a pair of adjustable fasteners and sewn to each seat middle side portion 108 (FIG. 1B). The support straps are attached with rows of stitches 73. The use of suspension rings 26, support straps 78 and four adjustable fasteners 40 allows for seat to be adjusted independently from adult's shoulder strap and be tailored to fit an infant. See FIGS. 1B through 4.

The seat is constructed of a fabric consisting of a seat body 15. This can be best observed in FIG. 1A. The seat body 15 may be made of any fabric such as canvas, nylon or the like. The seat body is defined by an upper edge 18, a lower edge 20, middle edges 61 and 62 and a pair of inwardly curved side edges 22 and 24 (See FIG. 1A). The length of the seat allows for upper back portion 104 to come up high on an infant's back, seat middle side portions 108 fully surround the infant's torso, and seat inwardly curved sides 22,24 being curved allow for extended thigh support. The seat lower portion 102 positions between the legs of the infant and attaches to the lower edge of waist belt 109 (See FIG. 8).

The seat 12 is sewn using rows of stitches (not shown) to waist belt 14. The seat is positioned substantially nearer to one of the sides of waist belt, as shown on the wearer in FIGS. 3 and 4. The positioning of seat to waist belt can be observed off the wearer in FIG. 1A. The waist belt 14 can be made of any high strength, flexible fabric such as canvas, nylon or the like. Along the ends of waist belt are sewn straps 44 and 45 that are fitted with length adjustable complimentary buckles 34 and 35. Upon fitting waist belt around adult the extra strap ends can be slid through waist strap guides 47.

With reference to FIGS. 2 through 7, the shoulder strap means includes a middle section—shoulder wrap 60—and shoulder straps 46, 48 and 50. This design enables the wearer to carry the infant with optimal comfort. The shoulder wrap consists of a top region 80 with a foam insert 84 that passes on top of the wearer's clavicle area, and a side region 82 that positions across the wearer's upper arm immediately below the shoulder Joint. The two regions 80 and 82 also combine directly on the shoulder joint to further distribute the weight and to fully utilize both the shoulder joint's smooth, rounded surface and the deltoid muscle's natural padding. The shoulder wrap 60 contains a concavity along the longitudinal axis and designed to both wrap and center itself on the shoulder joint of the wearer, see FIGS. 2 through 4. The shoulder wrap 60 also consists of two shoulder wrap attachments 86 that connect shoulder wrap to shoulder straps 46 and 50 which are made of a strap material.

Figure 3:
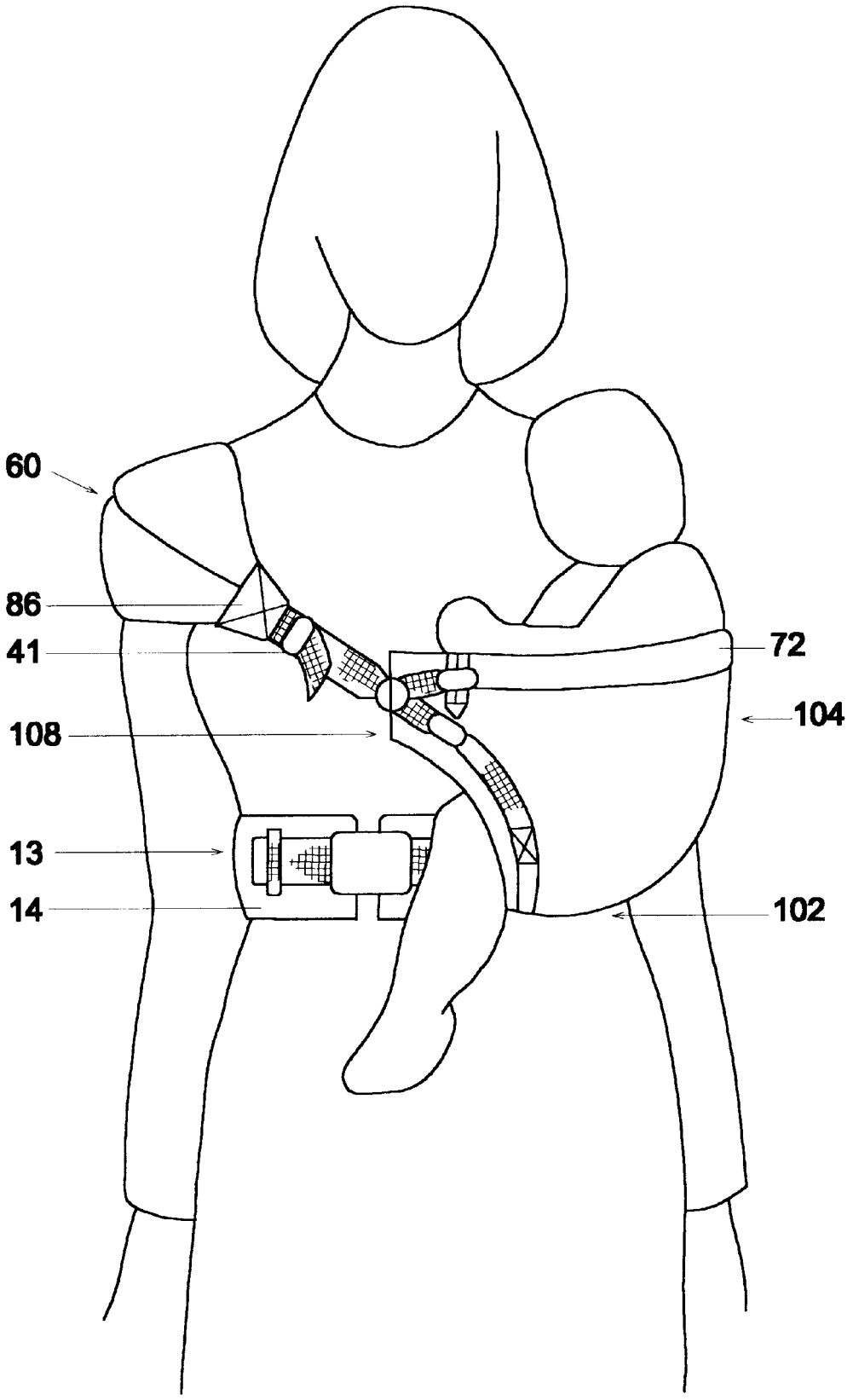
FIG. 3 is a schematic front side view of the apparatus in use.
Figure 4:
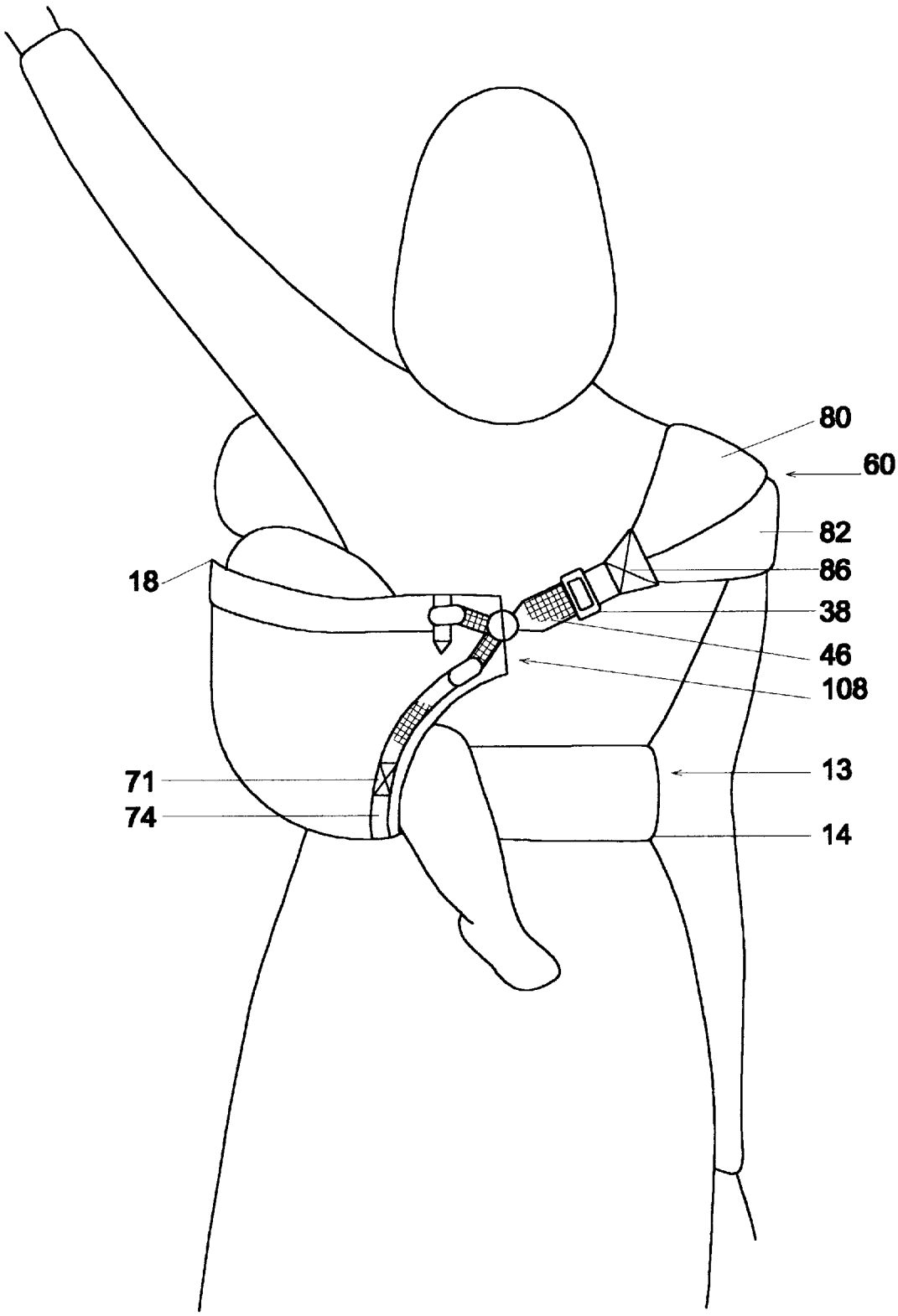
FIG. 4 is a schematic rear side view of the apparatus in use.
Figure 5:
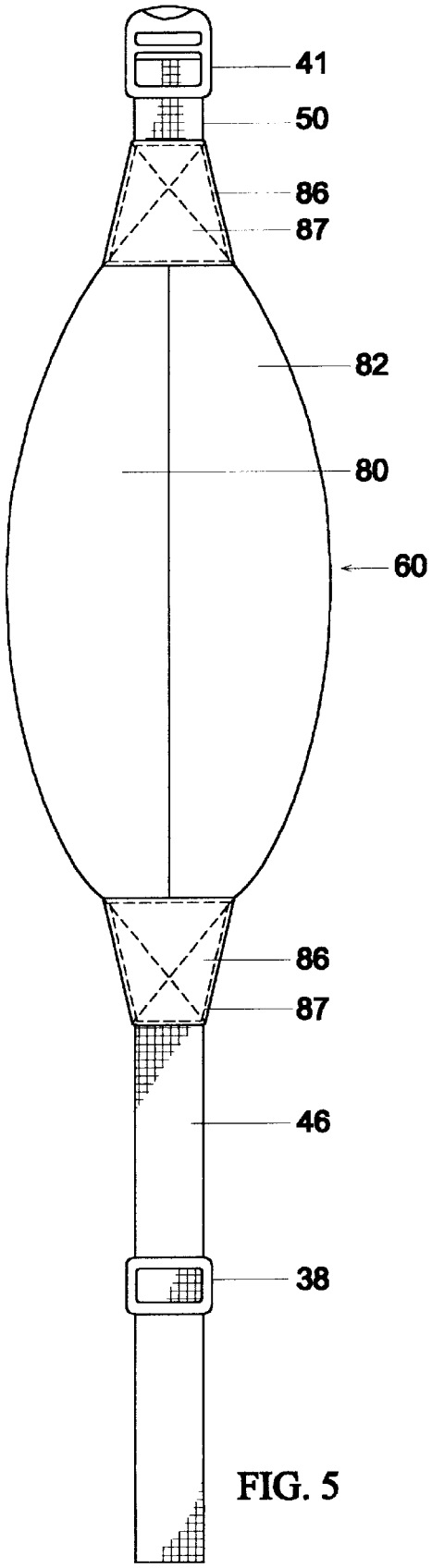
FIG. 5 shows a top view of the outside of the shoulder strap assembly as it would appear laid out flat on a table.
Figure 6:
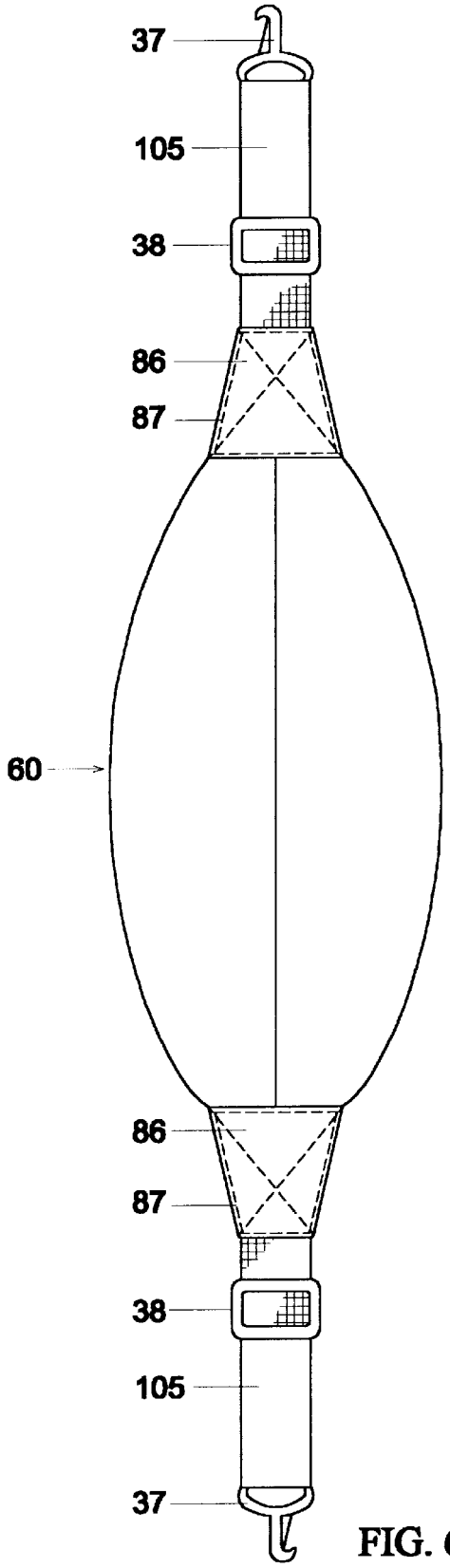
FIG. 6 shows a top view of the outside of the strap used for apparatus, luggage, athletic and computer bags or the like as it would appear laid out flat on a table.

With reference now to FIGS. 3 through 5, shoulder wrap 60 is attached to a short front shoulder strap 50 and a back shoulder strap 46 using sewn on attachments 86. The short front strap 50 is looped around an adjustable fastener 41 that is used to connect with a long front strap 48 which is fixedly attached Lo a suspension ring 26. The adjustable fastener 41 allows the adult to quickly remove the infant or position shoulder wrap. The shoulder strap back 46 attaches similarly to shoulder wrap using attachment 86. The shoulder strap back 46 is relatively long in length and loops through a suspension ring 26 and is both attached and adjusted with a bar slide 38. The centering of shoulder wrap on adult's shoulder joint requires bar slide 38 adjustment. Once shoulder wrap is positioned about the shoulder joint with infant seat 12 on adult's opposite hip, installation and removal of apparatus 10 only requires the use of an adjustable fastener 41 and complimentary waist belt buckles 34 and 35.

Figure 7:
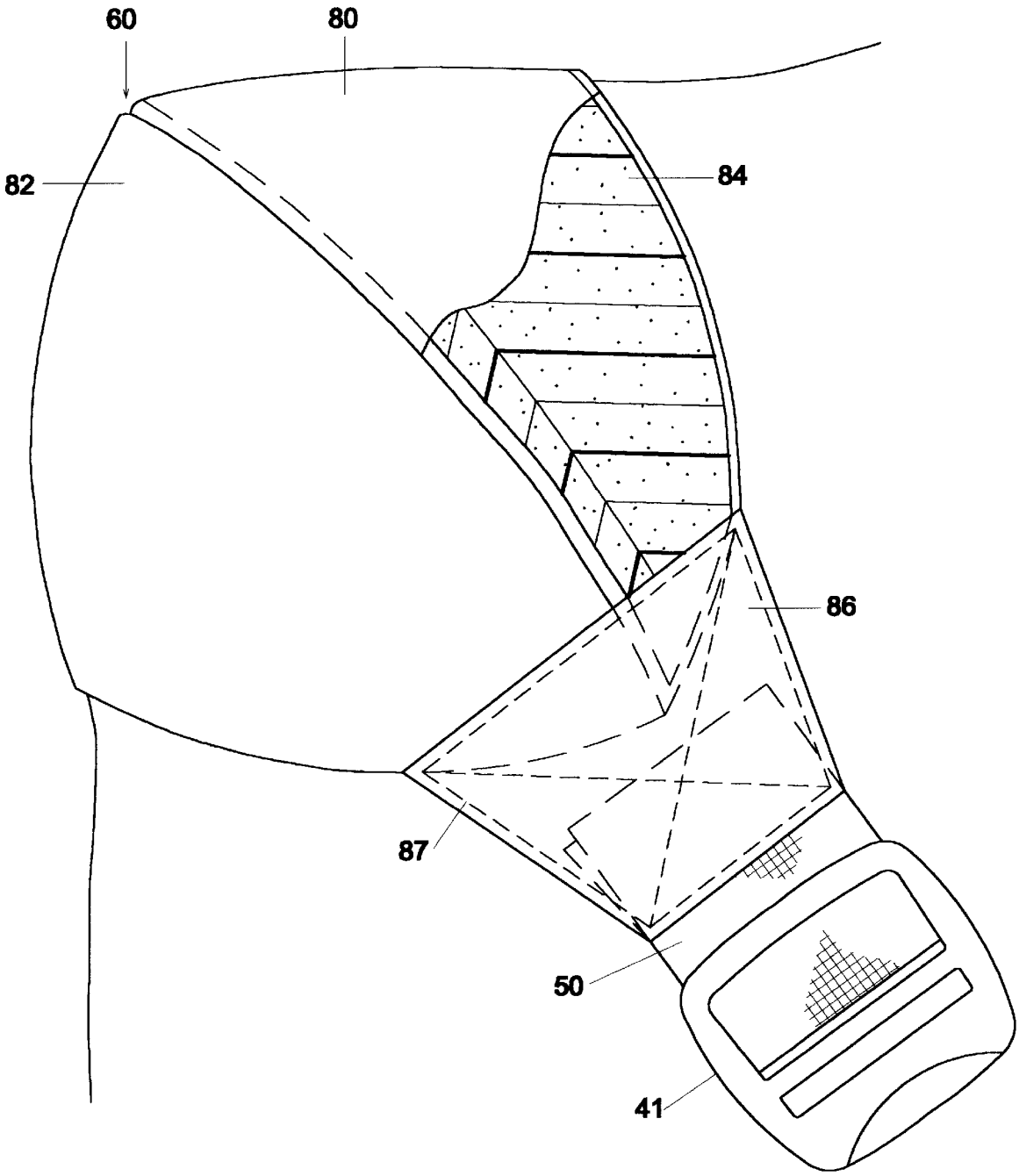
FIG. 7 is a partial sectional view of the middle section of the shoulder strap—shoulder wrap—in use. The a cut away shows the foam padding positioned over the clavicle bone area.

The shoulder strap means can be used with the fittings in FIG. 7 for apparatus 10 or used for other purposes such as: golf, luggage, mail bag or the like. By fitting shoulder wrap with strap material 105, simple length adjustable bar slides 38 and fasteners 37 any number of applications can be possible.

Figure 8:
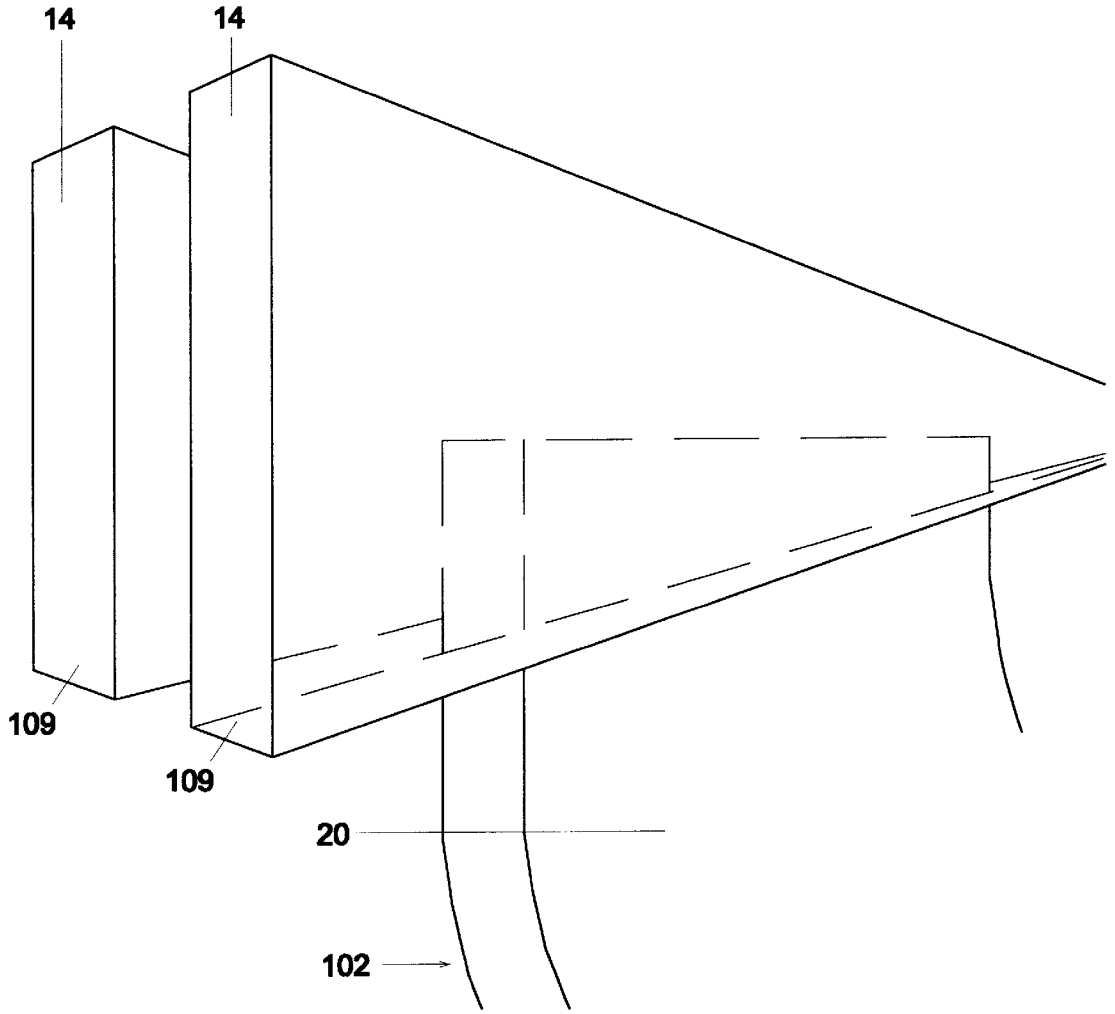
FIG. 8 is an assembly view showing the positioning of the lower seat into the waist belt.

The construction and arrangement of the seat 12 as shown in FIGS. 2, 3, and 8 is such that it does not come between the infant and the adult. The seat upper back portion 104 extends upwardly across the back of the infant and seat lower portion 102 is located in the crotch area of the infant, FIG. 5. The bottom portion 102 is sewn directly into the lower edge 109 of waist belt 14.

In use, the infant seat is positioned on the hip of the adult, below one of the adult's arms. The legs of the infant straddle the adult's hip and the infant's head is close to the adult's breast. The infant's torso is surrounded by seat with its high back and wrap around sides. The infant's weight is distributed to seat's large surface area giving extended thigh support, reducing discomfort to the child's hip and crotch area.

The infant's weight is dispersed between waist belt and shoulder wrap. The wide waist belt and shoulder wrap distribute the infant's weight across a large surface area reducing soreness and discomfort to the adult. The infant's seat features a high back, an adjustable soft frame, wrap around sides, and extended thigh support. The wide waist belt and shoulder wrap create an infant carrier that is comfortable for the adult wearer. Accordingly, both the infant and adult find the carrier to be of improved comfort.

It is therefore to be understood that various modifications and changes in the construction and arrangement of parts comprising the preferred embodiment of the present invention may be made without departing from the spirit and scope thereof as defined by the appended claims.

What is claimed is:

1. An infant carrier for conformally and adjustably supporting the thighs, hips, and entire torso of an infant comprising:

a) a seat means for supporting the infant and adapted to be located adjacent to the waist of an adult, wherein said seat means further comprises a frame formed from strap material; said frame surrounding a seating portion formed of fabric having edges, said seating portion being disposed to substantially span said frame surrounding said seating portion adjacent to said edges thereof;

b) a waist belt means for disposing about the waist of the adult for securing said seat means to the adult;

c) a shoulder strap means for disposing about the upper torso of the adult for connecting said seat means to the adult's shoulder.

2. An infant carrier according to claim 1, wherein said seat means has an upper break portion comprising an upper edge having a first length, a pair of inwardly curved side edges, and a lower edge having a second length shorter than said first length of said upper edge.

3. An infant carrier according to claim 2, wherein said upper edge of said seat means includes a sheath along its edge and said seat means further includes first and second seat straps, said first seat strap being fixedly attached substantially nearer to said lower edge and said second seat strap being contained within said sheath.

4. An infant carrier according to claim 3, wherein said second seat strap is longitudinally slidably accommodated in said sheath, and said sheath extends transversely at least part way along said upper back portion.

5. An infant carrier according to claim 3, wherein said seat straps are adjustable.

6. An infant carrier according to claim 5, wherein each of said first and second strap ends are secured to an adjustable coupling.

7. An infant carrier according to claim 6, wherein said adjustable couplings are fixedly attached to two distinct support straps.

8. An infant carrier according to claim 7, wherein said support straps are fixedly attached to said seat.

9. An infant carrier according to claim 8, wherein each of said support straps contains a suspension ring for attachment to said shoulder strap means.

10. An infant carrier according to claim 1, wherein said shoulder strap means is adapted to receive, in use, the wearer's shoulder region.

11. An infant carrier according to claim 1, wherein said waist belt means being fixedly attached to said seat means along said lower edge.

12. An infant carrier according to claim 11, wherein said waist belt means comprises a fabric belt and a pair of straps fixedly attached to the opposite end portions thereof.

13. An infant carrier according to claim 11, wherein said waist belt means comprises coupling means including a tongue adjustably mounted on one said strap and a cooperating receiving socket on the other said strap.

14. An infant carrier according to claim 1, wherein said seat means first and second seat straps are attached to said shoulder strap means through two distinct attachment locations.

15. An infant carrier for conformably and adjustably supporting the thighs, hips, and entire torso of an infant comprising:

a) a seat means adapted to be located adjacent to the waist of an adult;

b) a waist belt means for disposing about the waist of the adult for securing said seat means to the adult, c) a shoulder strap means for disposing about the upper torso of the adult for connecting said seat means to the adult's shoulder, said seat means further comprises a frame formed from two seat straps that are adjustably attached to said seat, said seat straps further connect to the shoulder strap through two distinct attachment locations.

* * * * *